US011001350B2

(12) United States Patent
Creppel

(10) Patent No.: US 11,001,350 B2
(45) Date of Patent: May 11, 2021

(54) SHALLOW DRAFT CONTAINER CARRIER

(71) Applicant: Gregg George Creppel, New Orleans, LA (US)

(72) Inventor: Gregg George Creppel, New Orleans, LA (US)

( * ) Notice: Subject to any disclaimer, the term of this patent is extended or adjusted under 35 U.S.C. 154(b) by 0 days.

(21) Appl. No.: 16/345,253

(22) PCT Filed: Oct. 27, 2017

(86) PCT No.: PCT/US2017/058781
§ 371 (c)(1),
(2) Date: Apr. 26, 2019

(87) PCT Pub. No.: WO2018/081574
PCT Pub. Date: May 3, 2018

(65) Prior Publication Data

US 2020/0031432 A1 Jan. 30, 2020

Related U.S. Application Data

(60) Provisional application No. 62/413,480, filed on Oct. 27, 2016.

(51) Int. Cl.
*B63B 1/06* (2006.01)
*B63B 35/00* (2020.01)
*B63B 35/28* (2006.01)

(52) U.S. Cl.
CPC ..... *B63B 35/28* (2013.01); *B63B 1/06* (2013.01); *B63B 2035/002* (2013.01)

(58) Field of Classification Search
CPC .... B63B 3/26; B63B 1/02; B63B 1/04; B63B 1/06; B63B 3/00; B63B 3/02; B63B 3/04;
(Continued)

(56) References Cited

U.S. PATENT DOCUMENTS 1,508,473 A 9/1924 Polis
1,900,711 A 3/1933 Howard
(Continued)

OTHER PUBLICATIONS

PCT, U.S. Patent and Trademark Office (ISA/US), International Search Report and the Written Opinion of the International Searching Authority, International Application No. PCT/US2017/058781, 7 pages (dated Jan. 5, 2018).

*Primary Examiner* — Anthony D Wiest
(74) *Attorney, Agent, or Firm* — Thompson Hine LLP

(57) ABSTRACT

A long, wide, and low-profile mono-hull vessel able to meet the requirements for an efficient, rapid, and reliable inland waterway container transport system. A shallow draft container carrier may comprise a self-propelled semi-monocoque mono-hull vessel having a double radius ogive bow and octet truss space frame structure. Additional features such as a forward bridge, full beam stern, and distributed electric propulsion system elements may be included. The design provides a vessel that is large, strong, ridged, and fast, able to operate in shallow water, resistant to debris accumulation, with large cargo capacity and low wind load, and potentially with zero-turn radius capability. The aspect ratio provides high capacity with high speed, low drag and fuel-efficient hull form. Integral bow and stern thrusters may provide enhanced safety, control, speed, maneuverability, and zero-turn radius capability. An electric propulsion system combined with traction motors and full beam stern layout may provide greater power while maintaining shallow draft operating capability and flexibility in cargo hold design.

9 Claims, 7 Drawing Sheets

(58) Field of Classification Search
CPC .... B63B 3/06; B63B 3/14; B63B 3/28; B63B 3/32; B63B 2035/002; B63B 25/004
See application file for complete search history.

(56) References Cited

U.S. PATENT DOCUMENTS

| | | | | | |
|---|---|---|---|---|---|
| 1,933,860 | A | | 11/1933 | Kjekstad | |
| 2,743,694 | A | | 5/1956 | McAlcer | |
| 3,934,531 | A | * | 1/1976 | Allen | B63B 1/06 114/63 |
| 4,398,490 | A | * | 8/1983 | Cutts | B63B 5/02 114/358 |
| 4,719,871 | A | * | 1/1988 | Fantacci | B63B 5/24 114/357 |
| 4,843,989 | A | | 7/1989 | Langenberg | |
| 5,937,777 | A | | 8/1999 | Azima | |
| 6,386,131 | B1 | * | 5/2002 | Barsoum | B63B 3/00 114/357 |
| 8,187,046 | B2 | * | 5/2012 | Rolla | B63H 23/06 440/53 |
| 2016/0208476 | A1 | | 7/2016 | Wadley et al. | |
| 2017/0101167 | A1 | * | 4/2017 | Howard | B63H 25/42 |

* cited by examiner

SHALLOW DRAFT CONTAINER CARRIER

This application claims the benefit of U.S. Provisional Patent Application Ser. No. 62/413,480, filed Oct. 27, 2016, the entirety of which is hereby incorporated by reference.

TECHNICAL FIELD

The present disclosure relates generally to an intermodal cargo container carrier for travel by waterways, and more particularly to a shallow draft container carrier that operates with a water draft of about twelve feet or less.

BACKGROUND

Container carriers, which may also be referred to as container ships, are cargo ships that carry their load using standardized containers. The approach of carrying cargo within a standardized container may be referred to as containerization. Containerization is a system of intermodal cargo transport using standardized containers that may be accommodated by container carriers, railroad cars, and trucks. The capacity of a container carrier may be measured in twenty-foot equivalent units (TEU). It is to be appreciated that container carriers are a popular mode for transporting non-bulk cargo. In fact, a majority of non-bulk cargo is transported by container carriers.

Some factors that may hinder the travel of a vessel along inland waterways currently available include, but are not limited to, shoals and sand bars, low water stand, ice flow, and locks and dams. For example, the controlling depth to gain access to the main channel of the Mississippi River is presently about forty-five feet. There are currently plans to dredge the Southwest Pass, which is one of the channels at the mouth of the Mississippi River, to a depth of about fifty-five feet. However, even if the controlling depth of the Southwest Pass is increased, navigation may still be restricted. Specifically, the controlling depth of the entire Mississippi River inland waterway system is twelve feet. This depth becomes more critical during periods of low water runoff such as, for example, the annual seasonal variation in water runoff during late summer and early fall, or during a draught, at which times the Army Corp of Engineers has a mandate to maintain the main channel at 12 feet. It should be appreciated that the channel depth of the Mississippi River above Baton Rouge shallows considerably. Thus, ocean-going vessels typically do not navigate above this point along the Mississippi River System.

There is an ever-growing demand for container-based cargo transport considering the increases in fuel costs, the advances in intermodal containerization technology, the efficiency of water transport, and the convenience and security of segregated point to point containerized cargo delivery. However, legacy barge and tow assets do not adapt well to the speed and efficiency required of the ever-changing intermodal container system of commerce. Furthermore, many vessels currently available may not be able to provide the volume capacity, speed, efficiency, and reliability required for a dedicated container distribution network. Thus, there is a need for a container carrier that includes enhanced volume capacity, is more fuel and labor efficient than competing modes of transportation, and can navigate shallow waterways at speed.

DETAILED DESCRIPTION

Figure 1:
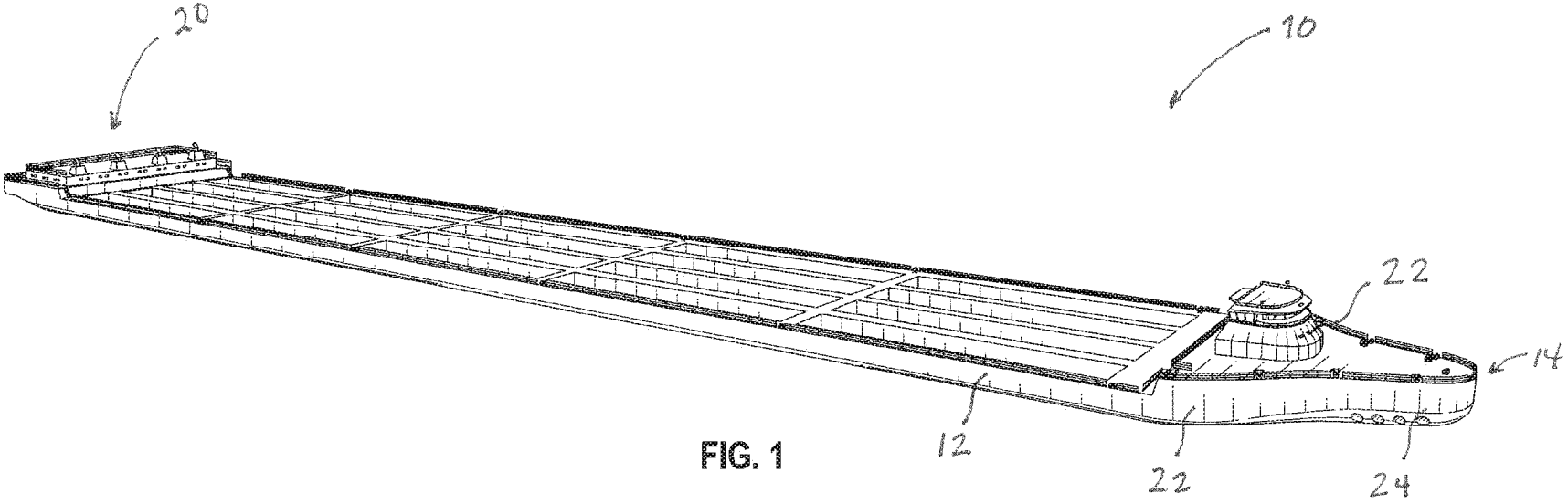
FIG. 1 is an elevated front perspective view of an exemplary container carrier.
Figure 2:
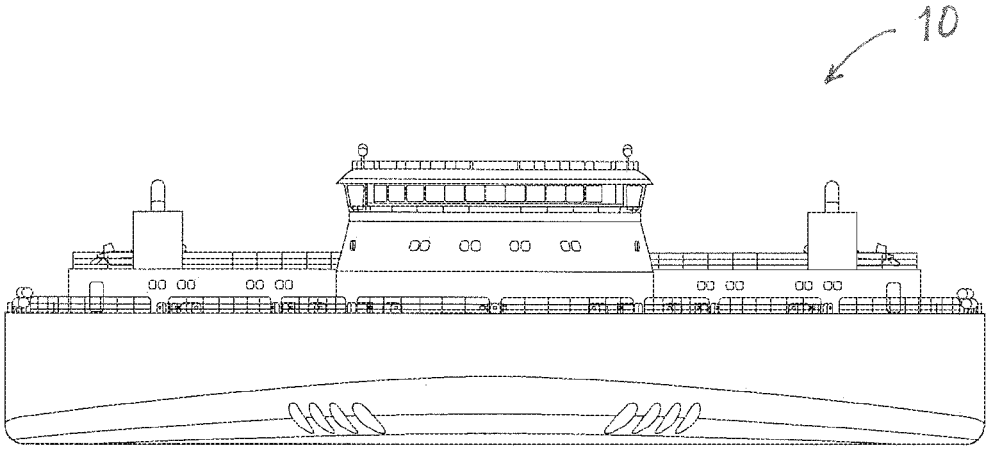
FIG. 2 is a front view of the container carrier of FIG. 1.

The following detailed description will illustrate the general principles of the invention, examples of which are additionally illustrated in the accompanying drawings. In the drawings, reference numbers indicate identical or functionally similar elements.

Figure 9:
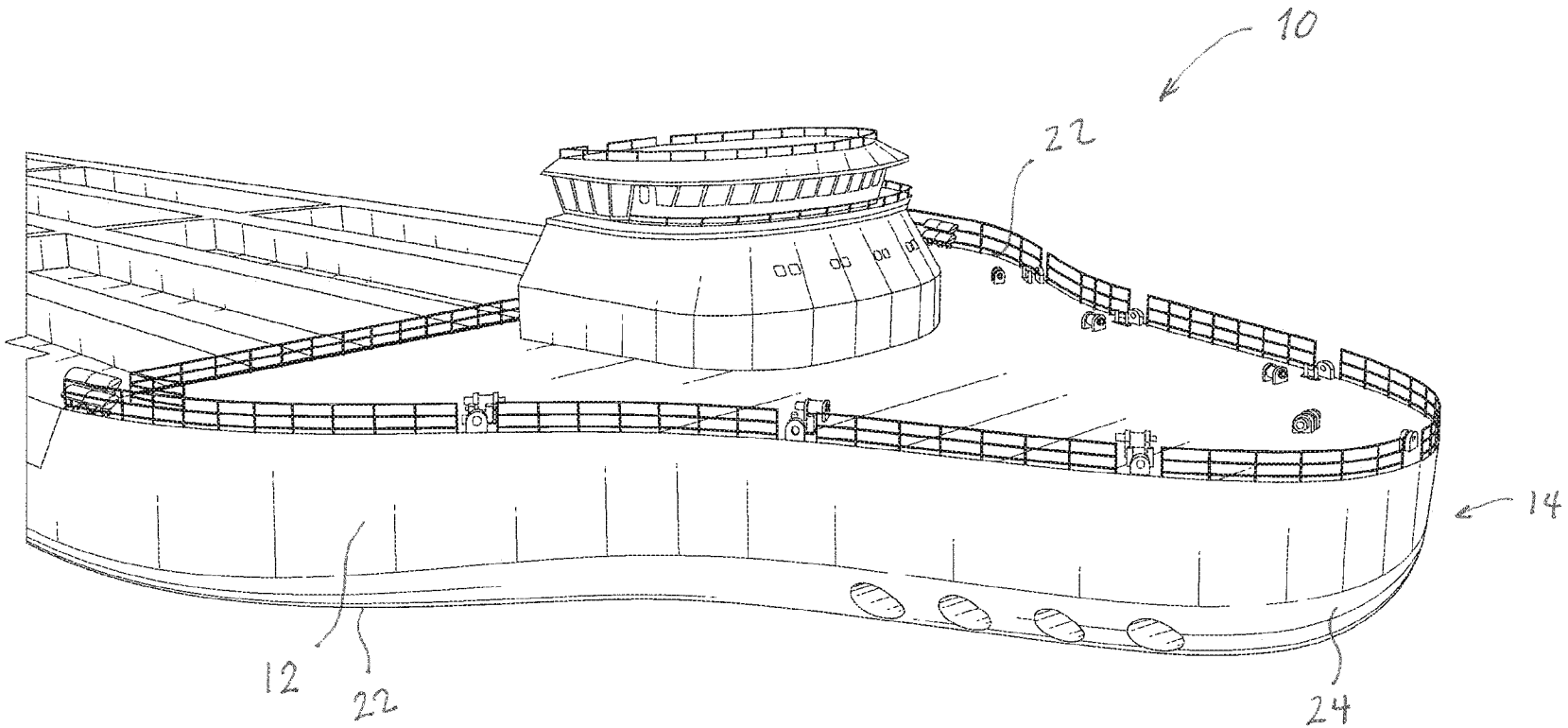
FIG. 9 is an enlarged, elevated front perspective view of a portion of the container carrier of FIG. 1.

FIGS. 1-9 generally illustrate an exemplary container carrier 10. Referring specifically to FIG. 1, the container carrier 10 may include an external hull 12 having a bow 14. Bow thrusters (not visible) may be provided at the bow 14. In one embodiment, the bow 14 may include four bow thrusters nominally rated at 2,500 HP each, thereby resulting in a total of 10,000 HP. As best seen in FIGS. 1 and 9, the bow 14 includes a double radius ogive profile. That is, the bow 14 includes two sides 22 that each include a rounded profile having a radius, and a roundly tapered end or ogive portion 24. In one embodiment, the double radius ogive bow may define two intersecting radii of about one hundred feet to produce a bow having a length of two hundred feet and a beam of two hundred feet as well, thereby forming an equilateral triangle. Those of ordinary skill in the art will readily appreciate that an equilateral triangle is a generally strong and stable structure. As explained in greater detail below, the double radius ogive bow 14 may provide various technical effects and benefits.

Such a Shallow Draft Container Carrier or "SDCC" may embody dimensions between 700 feet-1750 feet in length, and 100 feet-250 feet in beam. In illustrated exemplary embodiment, the container carrier 10 may include an overall length L of 1,500 feet and may be 200 feet in beam. In one embodiment, the container carrier 10 may operate with a water draft of about twelve feet (+/−10%), and an air draft of about 50 feet (+/−10%), thereby allowing for year-round navigation and transport operation on waterways as shallow as the Mississippi River inland waterway system.

Figure 3:
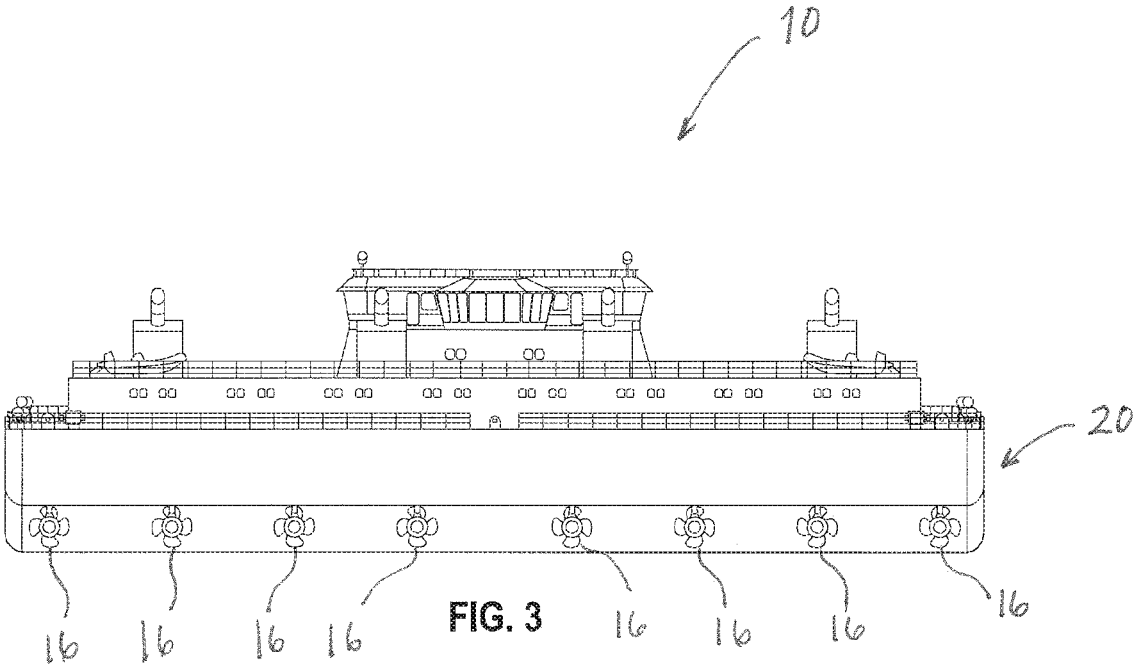
FIG. 3 is a rear view of the container carrier of FIG. 1.
Figure 4:
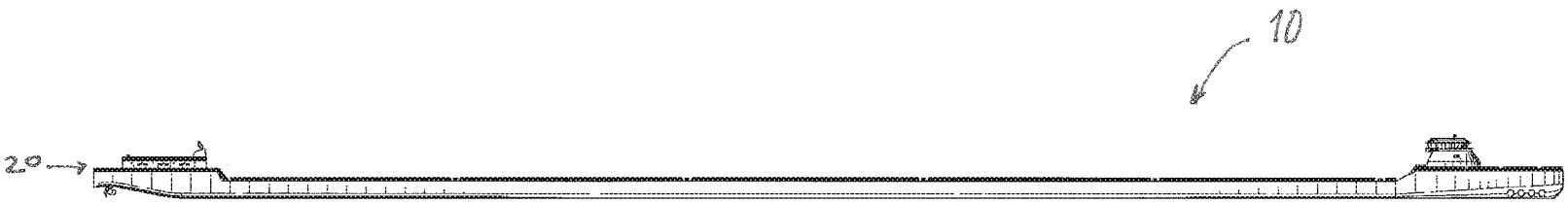
FIG. 4 is a view of a first side of the container carrier of FIG. 1.
Figure 5:
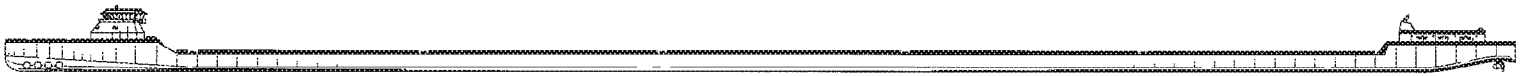
FIG. 5 is a view of a second side of the container carrier of FIG. 1.
Figure 6:
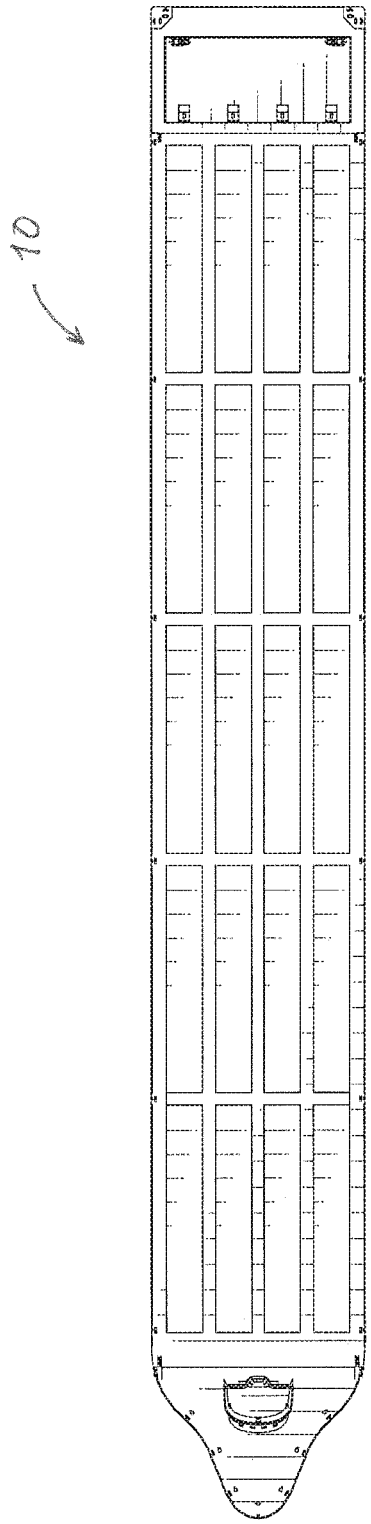
FIG. 6 is a top view of the container carrier of FIG. 1.
Figure 7:
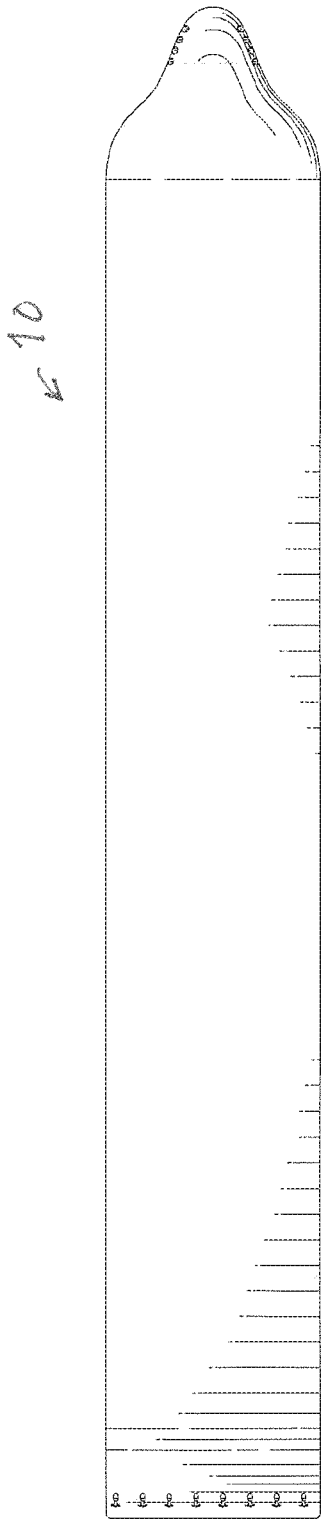
FIG. 7 is a bottom view of the container carrier of FIG. 1.
Figure 8:
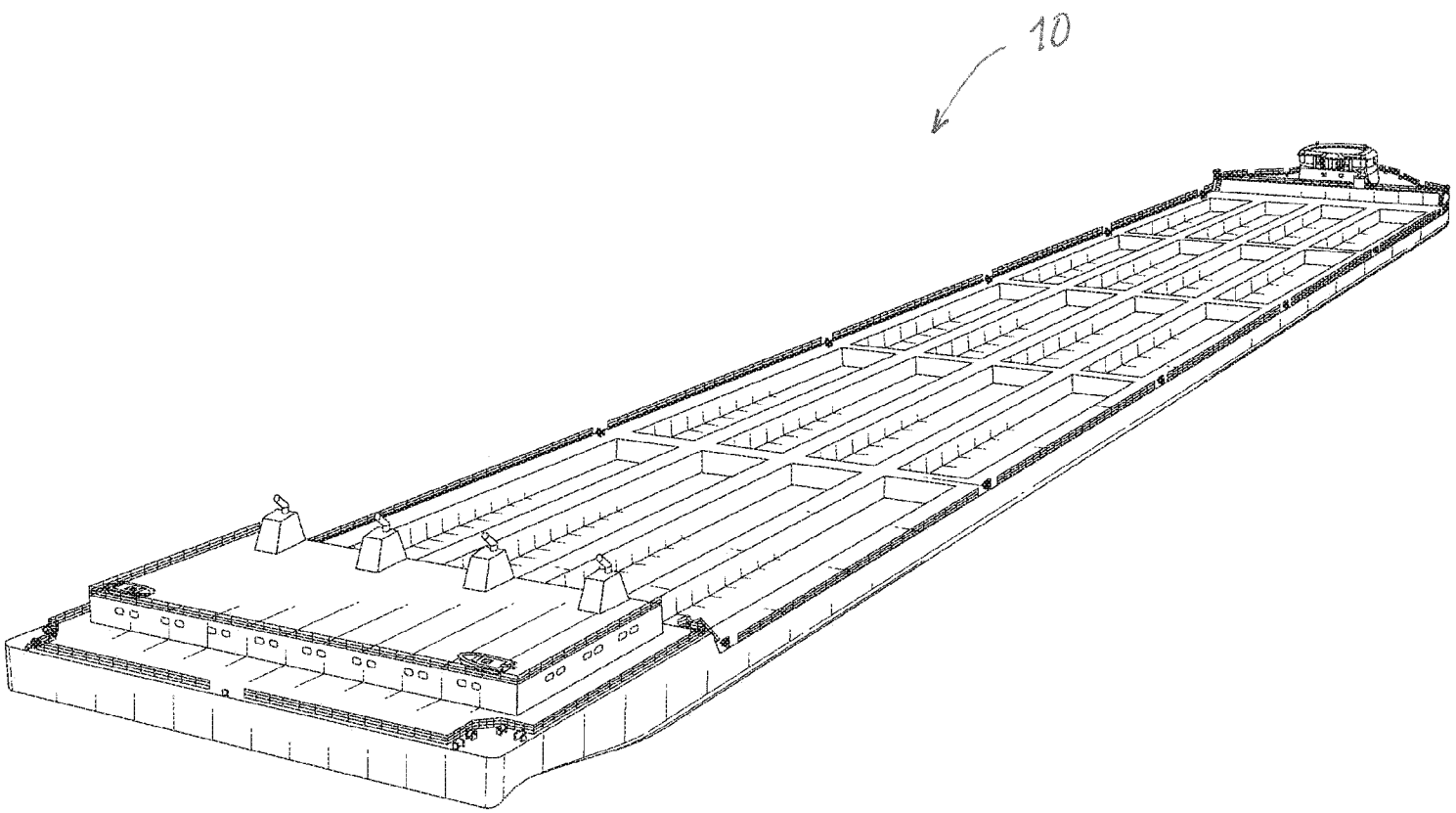
FIG. 8 is an elevated rear perspective view of the container carrier of FIG. 1.

The container carrier 10 may include a full beam stern 20. That is, the stern 20 of the container carrier, where the aft propulsion is housed, may have a width that is about equal to the midship beam of the container carrier 10 cargo hold area. As seen in FIG. 3, the stern 20 may be able to accommodate a plurality of thrusters 16. In the illustrated exemplary embodiment, eight thrusters 16 are utilized. In another embodiment, four thrusters 16 may be included. It is to be appreciated that by making the stern section of the container carrier 10 as wide as the midship beam, there is room along the stern 20 for a greater number of propellers. In other words, when compared to a conventional barge tow and push boat configuration, the container carrier 10 may be as wide as the tow, which means the container carrier 10 may be the same width as the configuration of individual barges of a conventional inland waterway transport tow. In one embodiment, the stern thrusters 22 may be nominally rated at 3500 HP each for a total of 14000 HP to 28000 HP at the stern, depending on the number of thrusters 22 used. It is to be appreciated that the power of the thrusters 22 may depend on the traction motors, the prime generator capabilities, and the desired hull speed of the container carrier 10. In one exemplary embodiment, the power distribution between the stern propellers and the bow propellers may range from about 75% to about 25%, and is based on the exact parameters of the container carrier 10. The particular configuration of the propulsion system will depend on the configuration of the vessel container capacity, and the waterway that the vessel is built to operate on.

It is to be appreciated that the disclosed container carrier 10 may include a length over all (LOA) to beam aspect ratio of between 5:1 and 8:1. Preferably, the aspect ratio is about 7:1 (+/−10%), which may produce a relatively high hull speed, with low drag and good fuel efficiency. In the illustrated exemplary embodiment, the container carrier 10 includes the following dimensions: Bow: 200'×200'; Stern: 200'×200'; and Mid-ship: 1100'×200'. In other embodiments, these exemplary dimensions may be scaled base upon length over all and/or beam. In the exemplary embodiment, the container carrier 10 has a displacement of about 100,000 dead weight tons, and may have a transit speed ranging from twelve to about eighteen knots while transporting up to twelve hundred 40' standardized containers, or 2400 TEU.

Figure 10:
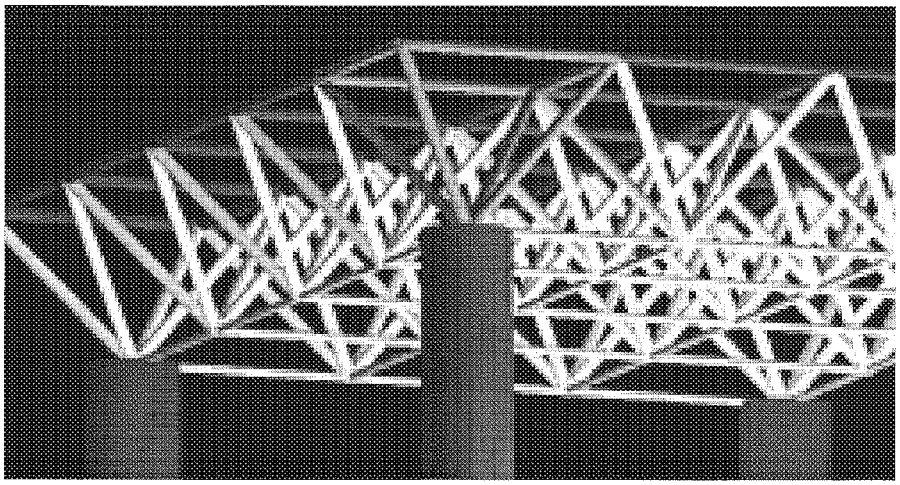
FIG. 10 is an exemplary illustration of a simplified space frame roof with a half-octahedron.
Figure 11:
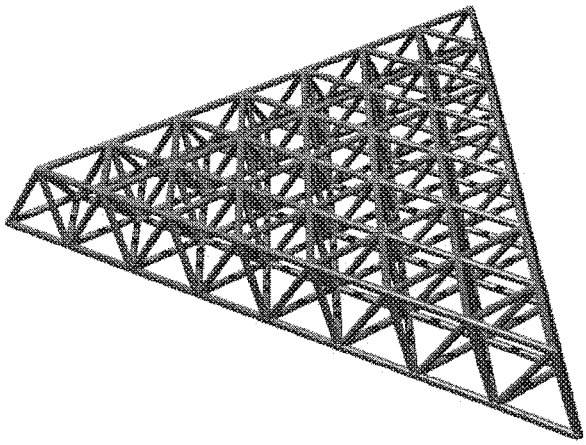
FIG. 11 is an illustration of an exemplary octet truss space frame.

It is to be appreciated that the container carrier 10 may not be built using conventional techniques employing a keel, ribs, stringer, and cladding. Instead, the container carrier 10 may utilize a semi-monocoque shell for cladding an internal truss space frame. In the illustrated exemplary embodiment, the space frame structure comprises a diamond lattice octet truss space frame structure. An example of the diamond lattice octet truss is illustrated in FIGS. 10-11. In materials, a diamond cubic crystal structure is a repeating pattern of 8 atoms (octahedron) that certain materials may adopt during solidification. The compressive strength and hardness of diamond and various other materials, such as boron nitride, may be attributed to the diamond cubic structure. Similarly, the truss systems illustrated in FIGS. 10-11 follow the diamond cubic geometry. Accordingly, the illustrated truss system may have a high capacity to withstand compression by reducing the unbraced length of individual struts. The internal framing may include structural members and nodes that utilize heavy wall drill pipe and steel ball bearings. In one exemplary embodiment, the shell may be constructed of a high-tensile alloy steel such as HY-100 steel plating that may provide load bearing characteristics similar to an aircraft fuselage. The monohulled design of the container carrier 10 may provide a relatively smooth outer surface, which in turn reduces drag by substantially eliminating broken surfaces and cavities found on a conventional barge tow. This characteristic will eliminate the tendency in conventional legacy barge and tow assets to accumulate debris in operation. Importantly, the monohulled design will eliminate the need to lash barges together as is required in conventional barge tow assets, this will save time, labor, equipment, and provide for a safer operation.

The container carrier 10 may experience horizontal impact loads and yaw bending forces (i.e., lateral movements along a vertical axis) imparted by the container carrier's own power when turning against a current. Thus, the container carrier 10 may include dimensions that combined with the lattice truss space frame structure may be strongest in this direction. Moreover, the bulkhead walls between the cargo holds, the cladding wrapping an exterior of the container carrier 10, and the cargo hold cavities, may act as a unit at the macro hull form level, and augment the strength and rigidity at the micro truss space frame level. In other words, the hull form and truss space frame combine to provide compressive strength and rigidity. It is to be appreciated that any load that is imparted upon the outer surface of the container carrier 10 may be distributed, absorbed, and dissipated throughout the entire vessel by the members of the diamond lattice truss space frame structure.

The individual truss members of the diamond lattice structure may be constructed of heavy wall sections of drill pipe (COTS), and the nodes connecting and aligning the truss members may be solid steel ball bearings (COTS), with pins drilled, screwed, and welded into place to insert into the drill pipes for alignment and assembly. The container carrier 10 may be fabricated using modular blocks. In the illustrated exemplary embodiment, 14 100 foot×200 foot blocks may comprise the components of the bow, stern, and mid-ship. This approach of modular blocks may facilitate the speed of construction of the container carrier 10, and may also provide quality control. The truss space frame structure provides an exceptionally light, rigid, and strong form while maintaining a low profile which reduces wind load while operating in narrow passage.

In one embodiment the container carrier 10 may include four generator sets, twelve electric drive motors, and two power transformers. One commercial example of the generators that may be used are the 12V38 Generator Sets (nominally 8000 Kilowatts each) available from the Wärtsilä Corporation of Finland. One commercial example of the electric drive motors that may be used is the Invertex 360T available from GE Transportation of Chicago, Ill. The traction motors and electric drive motors used within the container carrier 10 may be originally intended for mining applications.

Referring to FIGS. 1 and 9, the double radius ogive bow 14 may allow for fine entry of the container carrier 10 in areas of limited space, for reduced drag, and for bow thrusters providing directional control, including a zero turn radius capability while the carrier is underway. Furthermore, the double radius ogive bow 14 may also enable the bow 14 to reach full beam rapidly, which in turn results in increased cargo space. It is to be appreciated that the double radius of the ogive bow 14 may employ secondary outward structures to cancel primary bow wake. This would result in the container carrier 10 having a zero turning radius, that generates substantially no wake while operating at two-three times the speed of conventional legacy inland waterway transportation assets. Furthermore, this would also allow for the container carrier 10 to steer through a bend in a river without backing down the propellers of the stern 20, so as not to lose forward speed. Finally, the use of a distributed electric propulsion system in conjunction with bow thrusters in the double radius ogive bow 14 may also substantially eliminate the need for the container carrier 10 to cycle the engines, which in turn may reduce fuel burn and engine wear.

Referring generally to the figures, the disclosed container carrier 10 may provide various technical effects and benefits. Specifically, the disclosed container carrier 10 may include a octet truss space frame structure, a forward bridge and superstructure, a full beam stern, and bow and stern thrusters that may enhance speed, efficiency, maneuverability, and safety. The container carrier 10 may be less labor intensive, thereby requiring a small crew. Furthermore, the combination of double radius ogive bow 14 with a forward bridge may enhance visibility, speed and control. Finally, the mono-hull and aspect ratio of the disclosed container carrier 10 may be more fuel efficient than the conventional legacy barge and tow assets and other competing modes of transportation currently available.

While the forms of apparatus and methods herein described constitute preferred embodiments of this invention, it is to be understood that the invention is not limited to these precise forms of apparatus and methods, and the changes may be made therein without departing from the scope of the invention.

The invention claimed is:

1. A container carrier ship having a semi-monocoque mono-hull including a shell cladding an internal truss space frame, a midship cargo hold area including a plurality of open cargo hold cavities for receiving standardized container units, and a double radius ogive bow, wherein the shell carries a major part of the stresses on the semi-monocoque mono-hull, wherein the double radius ogive bow includes two sides having a rounded profile defined by a first radius and a roundly tapered end or ogive portion defined by a second radius, wherein the double radius ogive bow includes a bow thruster propulsion system configured to provide zero turn radius capability for the container carrier when underway, and wherein the container carrier operates with a water draft of about twelve feet or less.

2. The container carrier of claim 1, wherein the container carrier has a stern width that is about equal to a beam width of the container carrier at the midship cargo hold area.

3. The container carrier of claim 2, wherein the stern includes at least four propellers.

4. The container carrier of claim 1, wherein the container carrier has an overall length of between 700 feet and 1,750 feet and a beam width of between 100 feet and 250 feet.

5. The container carrier of claim 4, wherein the container carrier has an aspect ratio of overall length to beam width of between 5:1 and 8:1.

6. The container carrier, of claim 5, wherein the aspect ratio is about 7:1.

7. The container carrier of claim 1, wherein the semi-monocoque mono-hull has an air draft of less than about 50 feet.

8. The container carrier of claim 1, wherein the internal truss space frame comprises a lattice truss space frame structure.

9. The container carrier of claim 8, wherein the lattice truss space frame structure comprises a diamond lattice octet truss space frame structure.

* * * * *